US009949884B2

(12) United States Patent
Kaczmarek et al.

(10) Patent No.: US 9,949,884 B2
(45) Date of Patent: Apr. 24, 2018

(54) DEVICE FOR SPINE CORRECTION AND MEASUREMENT SYSTEM

(71) Applicant: BIO.MORPH Sp. z o.o, Warsaw (PL)

(72) Inventors: Wojciech Kaczmarek, Warsaw (PL); Krzysztof Ludwik Miańowski, Warsaw (PL); Marcin Stańczuk, Siedlce (PL); Grzegorz Kamiński, Jasienica (PL); Rafal Rosolek, Warsaw (PL)

(73) Assignee: BIO.MORPH Sp. z o.o, Warsaw (PL)

( * ) Notice: Subject to any disclaimer, the term of this patent is extended or adjusted under 35 U.S.C. 154(b) by 516 days.

(21) Appl. No.: 14/641,050

(22) Filed: Mar. 6, 2015

(65) Prior Publication Data

US 2016/0008203 A1 Jan. 14, 2016

(30) Foreign Application Priority Data

Jul. 14, 2014 (PL) ..... 408841

(51) Int. Cl.
*A61H 1/00* (2006.01)

(52) U.S. Cl.
CPC ..... *A61H 1/003* (2013.01); *A61H 1/008* (2013.01); *A61H 2201/1623* (2013.01); (Continued)

(58) Field of Classification Search
CPC ..... A61H 1/008; A61H 1/0292; A61H 7/007; A61H 2007/009; A61H 39/04; A61H 2201/0134; A61H 2201/0142; A61H 2201/0149; A61H 2201/1253; A61H 2201/1623; A61H 2201/1626; A61H 2201/1676; A61H 2201/1695; (Continued)

(56) References Cited

U.S. PATENT DOCUMENTS 6,132,004 A 10/2000 Carlino
6,152,950 A 11/2000 Shealy et al.
(Continued)

FOREIGN PATENT DOCUMENTS

CN 201076536 Y 6/2008
CN 201755264 U 3/2011
(Continued)

OTHER PUBLICATIONS

Polish Search Report for App. No. P.408841 filed Jul. 14, 2014.

*Primary Examiner* — Steven Douglas
(74) *Attorney, Agent, or Firm* — Ralph E. Jocke; Walker & Jocke

(57) ABSTRACT

A device for spine correction, in a particular human spines, has a keyboard with numerous adjacent segments comprised of opposed back supports. The keyboard (3) has at least one set of cooperating segments A, B and C supported on curved arch elements which bias a patient back in engagement with the keyboard toward a desired back configuration. The device includes a support frame (1), and a relatively movable mobile frame (2) on which the keyboard is supported. A measurement system includes a controller (49), a server (50) and a screen (51). The controller is connected to sensors (26) which determine rotational positions of the segments. The server provides outputs from the screen (51) responsive to the sensed data.

21 Claims, 14 Drawing Sheets

(52) U.S. Cl.
CPC ..... *A61H 2201/1676* (2013.01); *A61H 2201/5007* (2013.01); *A61H 2201/5061* (2013.01); *A61H 2201/5069* (2013.01); *A61H 2203/045* (2013.01); *A61H 2203/0456* (2013.01); *A61H 2205/081* (2013.01)

(58) Field of Classification Search
CPC ..... A61H 2201/5007; A61H 2203/04; A61H 2203/045; A61H 2203/0456; A61H 2205/081; A61H 1/003; A61H 2201/5061; A61H 2201/5069
See application file for complete search history.

(56) References Cited

U.S. PATENT DOCUMENTS

2004/0158176 A1* 8/2004 Park ..... A61H 15/0078 601/18
2006/0287627 A1 12/2006 Johnson
2007/0173750 A1* 7/2007 Hudock ..... A61H 15/00 601/128
2010/0004684 A1* 1/2010 Rogachevsky ..... A61H 1/0218 606/242
2011/0288586 A1* 11/2011 Auman ..... A61B 5/1077 606/242
2014/0364910 A1* 12/2014 Ren ..... A61F 5/042 606/242
2015/0272808 A1* 10/2015 Lee ..... A61F 5/01 606/240
2016/0008211 A1* 1/2016 Yang ..... A61G 5/125 601/122

FOREIGN PATENT DOCUMENTS

CN 103230314 A 8/2013
DE 10153286 A1 5/2003
EP 9504488 A1 2/1995
WO 2013087009 A1 6/2013
WO 2013088182 A1 6/2013

* cited by examiner

DEVICE FOR SPINE CORRECTION AND MEASUREMENT SYSTEM

TECHNICAL FIELD

An exemplary embodiment is a device for correction of the spine, that can be used for dynamic correction of the spine, in humans in particular, which results in restored physiological joint mobility in the blocked joints of the spine. The exemplary embodiments are members of a group of physiotherapeutic gymnastic-correction devices and are intended to support physiotherapy of the spine. Such devices are used mostly by specialists providing medical physiotherapy services, such as physicians, persons holding master's degrees in movement rehabilitation, physiotherapists and, in particular, specialists in manual medicine, namely chiropractors. Example embodiments also include a measurement system that enables recording the progress of the patient.

BACKGROUND

There are known scoliosis correctors and stretching-correction devices used for therapy of pain of perivertebral muscles, for example in discopathy. However, these solutions may not enable the performance of full dynamic correction which restores physiological joint mobility in the blocked joints of the spine.

U.S. Pat. No. 6,132,004 describes a system of pillows that support the spine in the sitting position, which is intended for persons suffering from pain of the spine.

European Patent Application No. EP0712286B1 describes an adjustable support of a seat with a profile that matches the curvature of the spine of the sitting person.

Published PCT Patent Application No. WO2013088182A1 describes a device for treatment and rehabilitation of patients with spinal pain. The device comprises a frame, divided into two parts, which enables performance of procedures in the sitting position and with the patient lying face down. The principle of operation of the device is based on appropriate stretching (pulling) of the vertebrae of the patient's spine, in the sitting position with traction devices fixed to the patient's arms, and in the case of the lying position, by means of traction devices fixed to the patient's ankles. The use of drive devices enables the performance of dynamic procedures.

Published PCT Patent Application No. WO2013087009A1 describes a system for changing the line of vertebrae as a result of stretching. The patient is placed on a bed or table of the device, on a supporting element located on the level of the lumbar lordosis. Stretching with an appropriate force and at an appropriate angle affects the vertebrae of the spine.

The state of the art also includes two solutions of the Applicant, disclosed in Poland patent documents nos. PL 215141 B1 and PL 215142 B1.

Patent Document No. PL 215141 B1 presents an orthopaedic curvature corrector, especially for the human body, intended for correcting bad posture. The device comprises arched cams with a curved arch surface, curvilinear surface or components in the form of a convex upper support in the case of a neck lordosis, concave central support in the case of breast kyphosis and a convex lower support in the case of lumbar lordosis, which form a surface or elements of supports in the form of convex, concave or ellipsoidal cams with curvilinear shapes and curved arch surfaces of arched shapes, which are tangent to the back and, due to their shape, are automatically shortened or extended depending on the size, shape and structure of the elements that support the patient, on the shape of the spine or on the shape on the back. The arches of those elements represent, in a negative and inertia-based manner, the correct bends of the spine as a result of pressure tangential to the supported elements, namely the back. The elements mutually interact with each other—by moving in a complex rolling and sliding motion, thanks to the fixing connections in the guiding holes and correct proper bends of the spine.

Patent Document No. PL 215142 B1 discloses a device for dynamic correction of the spine, in particular for the human body, during which correction physiological joint mobility is restored in blocked joints of the spine. In the device, in the long axis of the spine, there are actuators which are set tangentially in the vicinity of the bases of the spinous processes in the individual segments of the spine. By performing dynamic springing action, the actuators treat and correct the spine by restoring joint mobility in the blocked joints of the spine, in particular the human body, during dynamic rotational movement of the relieved spine. Rotational movement of the spine is achieved thanks to the action of the entire kinematic chain, which is the movement of alternately moving upper and lower limbs. In more severe cases of pain, or depending on the condition, due to a motor mounted on the support axis or to other drives that apply an external force, passive movement is achieved in a relieved state or other set movement, according to the indications for therapy, with a dynamic corrector. The starting position for movement in this device is the position of the spine described as neutral, i.e. intermediate position between a bent position and a straight position. In this position, the joint surfaces are under the lowest load in the so-called movement part, and the stabilizing system, namely the muscles, the ligaments and the joint capsule, are under the least tension.

Such an approach enables physiological joint mobility in blocked joints, but the representation of movement in the joints is not completely precise.

The prior known devices, approaches and techniques may benefit from improvements.

SUMMARY

An exemplary device provides dynamic correction that restores precise and accurate physiological joint mobility in blocked spine joints. Specific stabilization and correction of the spine is achieved, in a traction position, which enables simultaneous muscular training, while restoring the mobility of spine joints in a very broadly defined therapy of the spine. The exemplary device is designed so that it can be used to conduct very thorough muscular training, enabling performance of rotational movements of individual elements of the spine, which are both corrective movements and movements that mobilize the joints of the spine. The example device enables achieving spine rotation movement in the corrected position by way of alternating movements of the upper and lower limbs and by way of alternating use of an external force for this purpose, namely a passive movement drive—the movement drive of the torsional axis, thus resulting in passive movement or another predefined movement.

A purpose of an example embodiment is to develop a device for rehabilitation of all sections of the spine, which, using rotational exercises performed by the patient, increases the range of movement of the vertebrae of the spine, improves movement coordination, corrects bad posture and positively influences physical fitness and the general well-being of the patient. The feature of the exemplary solution is universality, the broad group of interested patients who can use the device, with regard to both the patient's size and his or her disease, and the possibility to adjust movement resistance according to the patient's fitness level and to safety needs.

Moreover, a useful aspect of some exemplary arrangements is the possibility to record, using a measurement system, the progress and the changes in different patients as a result of the rehabilitation performed using the device. This increases safety and ensures control over the rehabilitation process.

An example device for spine correction comprises at least one keyboard, with at least one set of cooperating segments A, B and C supported on curved arch elements, whereby the framework comprises a support frame and a movable frame on which the keyboard is located.

The exemplary segments A, B and C each have a support part and two ribs, whereby the longer arms of the support part of segment A are narrower than the longer arms of the support parts of segment B and segment C; also, the lower brackets of the elastic elements of segment B are rotated 180 degrees in relation to the lower brackets of the elastic elements of segment C.

The exemplary ribs have a separate base that is swivel connected, through a kinematic couple, with a back support on the side of the patient rolling axis, and additionally through a spring assembly, whereby the back support on the side of the patient rolling axis ends with a pushing device, and on the bottom of the base of the rib, there is a curvature.

In the example arrangement, segments A, B and C cooperate with each other through flexible elastic elements. The support part comprises adjusting calibrating elements in the form of at least two guide grooves located symmetrically in the lower support part. Additionally, in the example guide groove, there is at least one curved arch element, on which at least one curvature portion associated with the rib is supported.

In example arrangements, a factor that corrects the curvature of the back are curved arch elements with predefined, finite shapes. The example device has a set of curved arch elements located symmetrically along the plane passing through the patient rolling axis. In an example device at the base of the support part, there are sensors for measuring the rotation angle of the individual segments of the plurality of segments and consequently the patient spine.

In the exemplary embodiment the support part on the external ends of the opposite longer arms has shaped cutouts, in which a zeroing rod may be located. At the base of the movable frame, there are two symmetrically positioned resistance mechanisms for the lower limbs, each including a thigh frame connected through a kinematic couple, to a shin frame ending in a stirrup. The thigh frame is connected to the shin frame with a resistance assembly that includes elastic elements that comprise a pulling gas spring and a hydraulic choke, whereby on the inner side of the thigh frame, a profiled support is located.

In the example device, the movable frame ends at the top in two symmetrical resistance mechanisms for the upper limbs. The resistance mechanisms are connected to a common mounting base. The base is connected, through a kinematic couple, to at least one arm, connected through a kinematic couple to a forearm, ending with an end assembly. The exemplary arm and forearm are connected to a main resistance assembly, which comprises elastic elements comprising a pulling gas spring and a hydraulic choke. On the outside, the exemplary arm and forearm are surrounded with a parallelogram mechanism, namely a connection of the articulated joint node with a spreader of the arm and a spreader of the forearm; wherein, the arm is connected to the mounting base through an auxiliary resistance assembly.

The exemplary measurement system used with some embodiments includes a controller that is connected to a set of sensors operative to sense positions of segments A, B and C of the device for spine correction. A server in operative connection with a visual display is connected to the controller. The server may comprise a PC such as a monoblock PC.

DETAILED DESCRIPTION

Figure 1A:
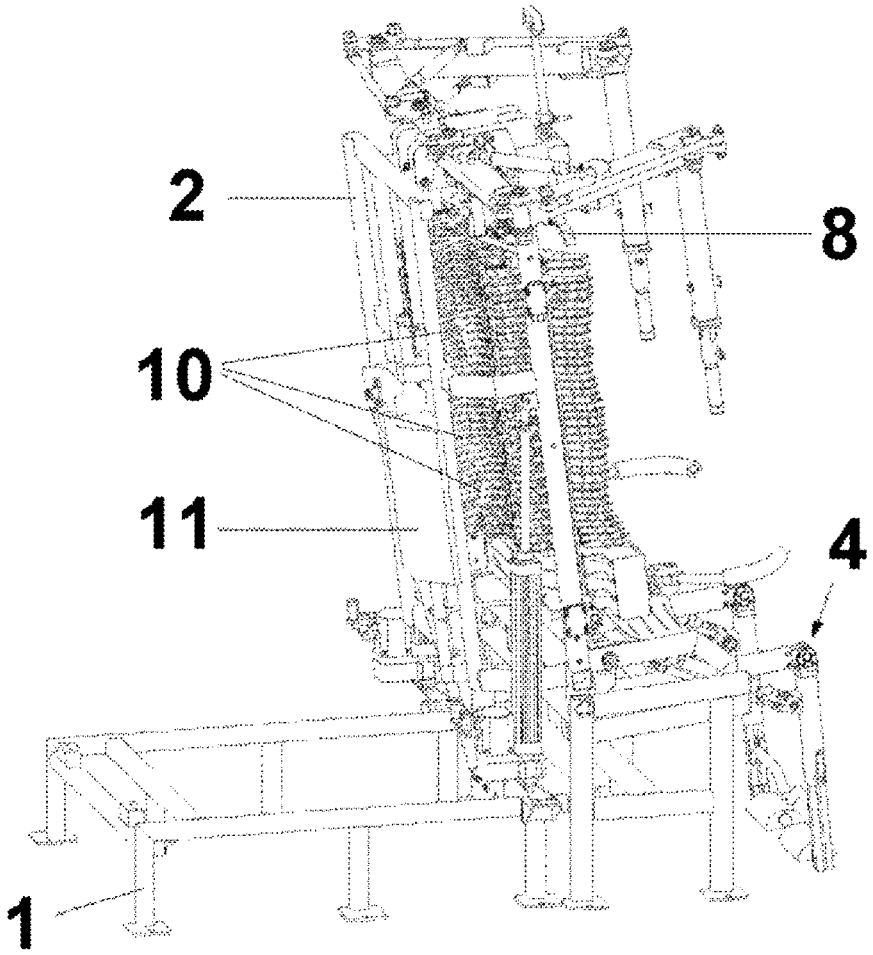
FIG. 1*a* shows a schematic view of the side of an example device for spine correction, in the sitting position.
Figure 1B:
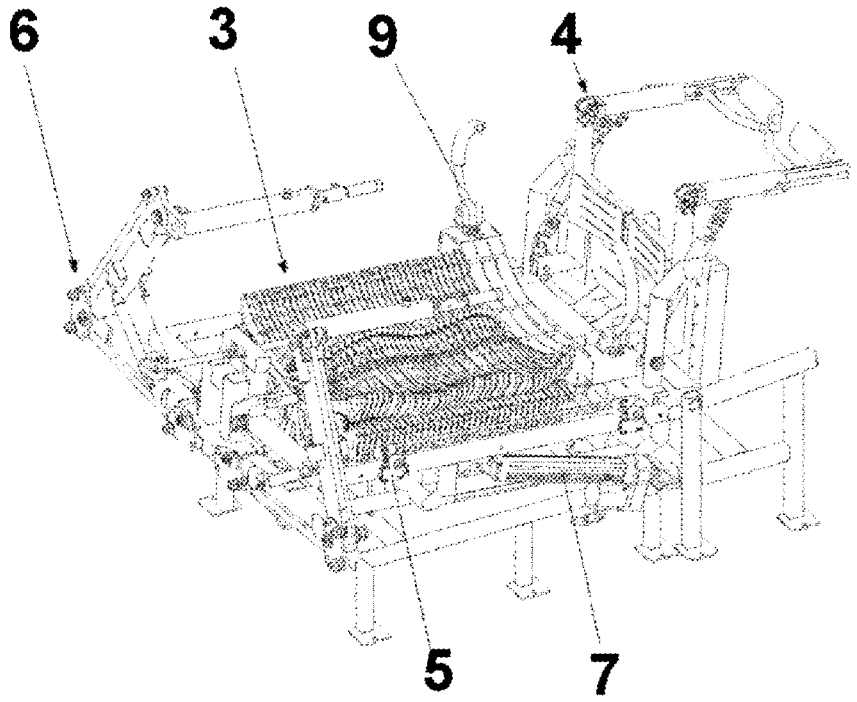
FIG. 1*b* shows a schematic view of the side of an example device for spine correction, in the lying position.
Figure 2:
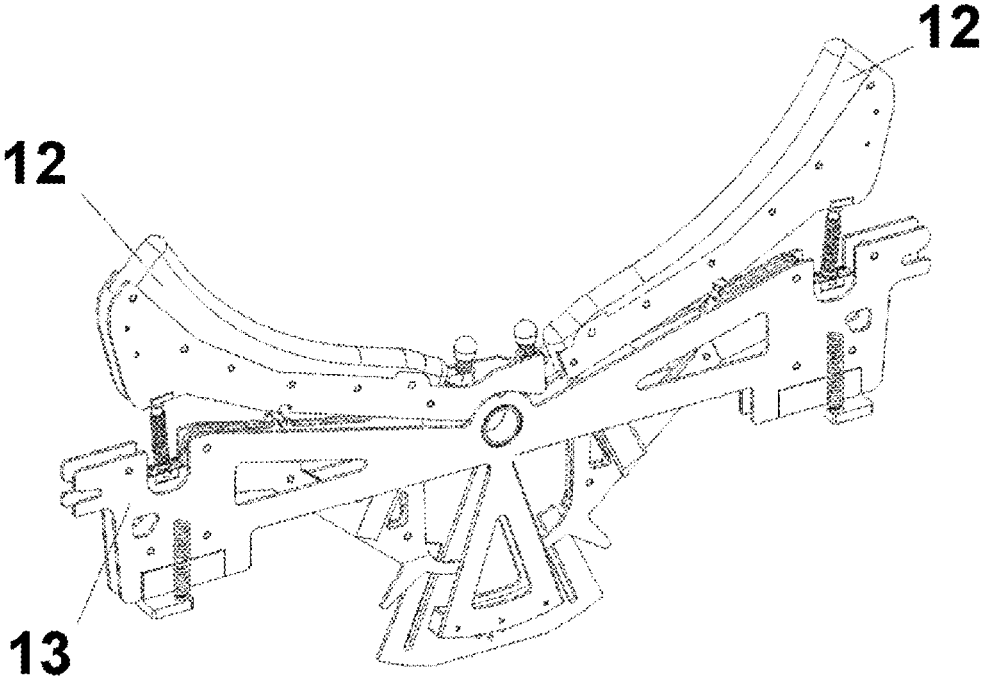
FIG. 2 shows a schematic view of a single segment of the exemplary keyboard.
Figure 3:
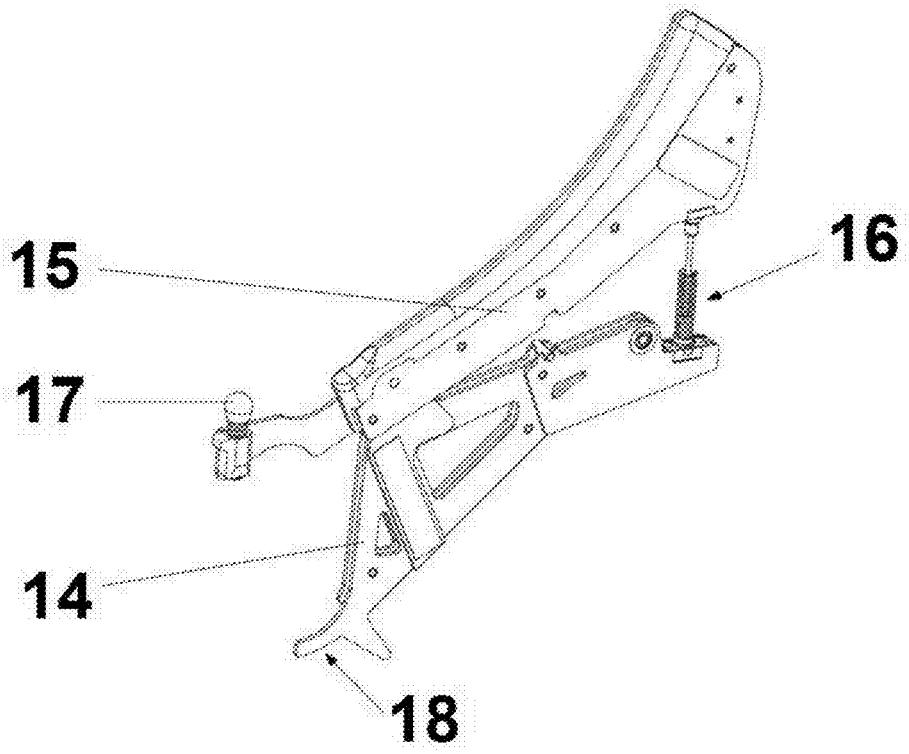
FIG. 3 shows a schematic view of the side of a single rib of a keyboard segment.
Figure 4:
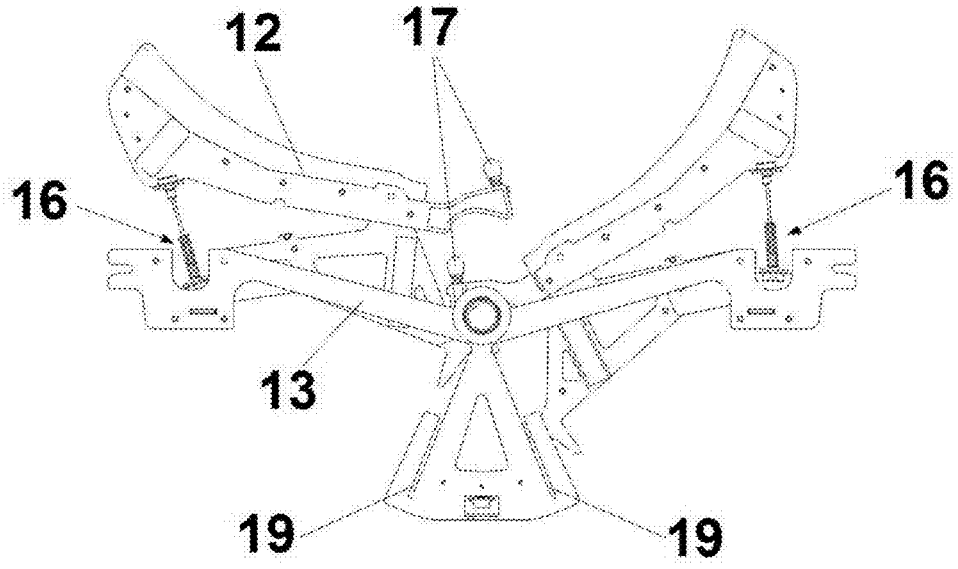
FIG. 4 shows a schematic view of the front of a single keyboard segment with the segment ribs extended the furthest.
Figure 5:
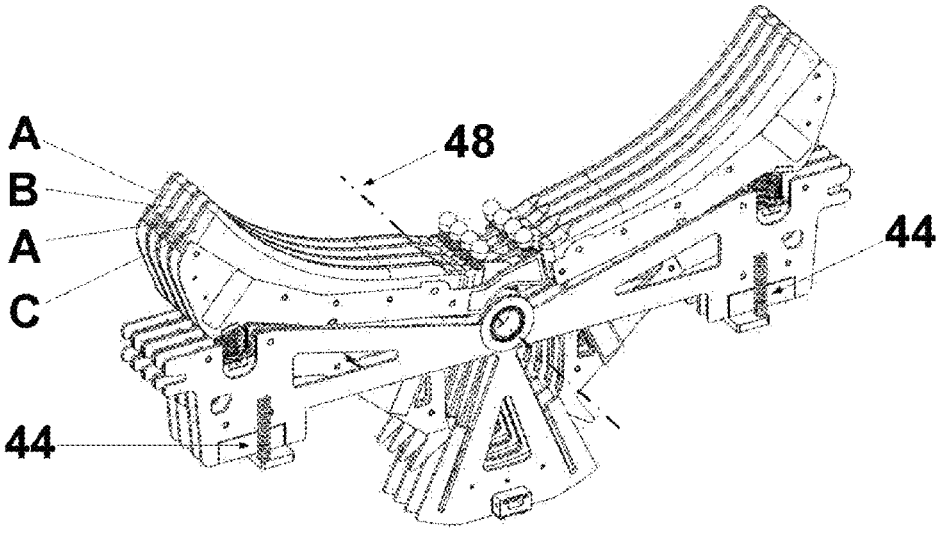
FIG. 5 shows a schematic view of a part of the keyboard with the rolling axis marked.
Figure 6A:
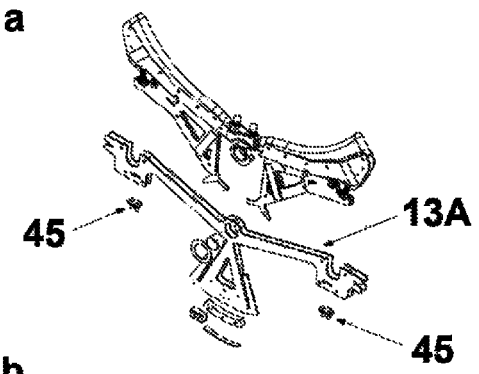
FIG. 6*a* shows a schematic exploded view of segment A.
Figure 6B:
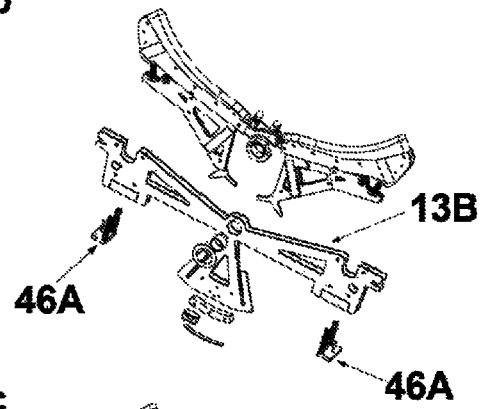
FIG. 6*b* shows a schematic exploded view of segment B.
Figure 6C:
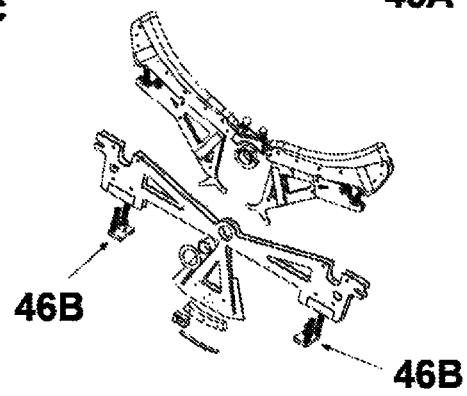
FIG. 6*c* shows a schematic exploded view of segment C.

In one example embodiment, a device for spine correction has a fixed arm 1 that is 1,600 mm long and 560 mm high, at the highest point, i.e. in the part where the mobile frame 2 is mounted, and 1,100 mm wide. On the other hand, the movable mobile frame 2 is attached in a movable manner on the fixed frame 1, which is 1,450 mm high, 1,050 mm wide and 800 mm deep. Centrally, in the upper part of the exemplary mobile frame 2, a Glisson loop 8 is mounted, and the distance measured from the base of the frame 2 to the end of the Glisson loop 8 is equal to 1,800 mm.

The mobile frame 2, due to a driving assembly 7, can change its position in relation to the fixed frame 1, from the initial position, namely the vertical position, to the working position, namely the horizontal position. This starting position guarantees that the patient starts the procedure in a safe fetal position. On the side of the mobile frame 2, facing the fixed frame 1, the drive of the torsional axis 11 is mounted, which acts as an element that supports rehabilitation. On the opposite side of the mobile frame 2, in its lower part, a lock of a side belt 9 is located, which, together with the Glisson loop 8, ensures safety and stabilization of the patient. On the mobile frame 2, a keyboard 3 is also located, which in the exemplary arrangement is 750 mm long and comprises 37 segments.

In the exemplary keyboard 3, there are three types of segments—segments A, B and C, which cooperate with each other through elastic elements 44, such as springs. Each segment includes a support part 13 and two identical ribs 12. The support part 13 is a welded structure consisting of sheet metal parts, such as brackets and separators, and of spreading elements. The support part 13 cooperates with the beam of the mobile frame 2 though a slide bearing set in the main sleeve. The axis of the beam is the patient rolling axis 48, namely the rotation axis, with simultaneous extension with the correction of the spine's curves maintained in the neutral positions.

In the example structure of the support part 13, there are brackets 45, 46A and 46B of the elastic elements that position and secure the elastic elements 44, which connect the neighboring segments A, B and C of keyboard 3. The elastic elements 44 that are used are fixed symmetrically between segments A, B and C, on both sides of each segment. This approach enables even distribution of the torsional moment on the individual segments of the keyboard 3, thus enabling even working of the spine along its entire length, while preserving its anatomic bends. The maximum total angle of torsion of the exemplary keyboard 3 between the first and the last segment is up to 90 degrees. Consequently, two neighboring segments must be able to turn in relation to each other by about 2.5 degrees in both directions. This solution secures and enables use of the maximum mobility of successive segments of the patient's spine in relation to each other and of a predefined movement.

As has been mentioned, the exemplary segments A, B and C each have a support part 13 and two ribs 12. The longer arms of the support part 13A of segment A are narrower than the longer arms of the support parts 13B of segment B and segment C in a direction transverse to segment movement. Also, the lower brackets 46A of the elastic elements of segment B are rotated 180 degrees in relation to the lower brackets 46B of the elastic elements of segment C. The separate upper brackets 45 of the elastic elements are located in the support part 13A of segment A. Additionally, each exemplary support part 13 comprises adjusting calibrating elements in the form of two guide grooves 19 located symmetrically in the lower section of the support part 13.

The exemplary keyboard 3, through the set of support parts 13, may represent the variable geometry of the surface of the human back, thus constituting mobile dynamic support for the human back.

Each rib 12 of the exemplary segment comprises a separate base 14, which is swivel-connected on the side of the patient rolling axis 48 through a kinetic couple of the 5th class with the back support 15. The kinematic couple of the 5th class can be a roller articulation, such as a slide bearing. Additionally, a rib 12 with the base 14 of the rib is connected on the external end through the spring assembly 16. The back support 15, on the transverse side of the patient rolling axis 48, ends with a pushing device 17. The exemplary pushing device, by pressing the space in the vicinity of the perivertebral muscles, massages those muscles, i.e. presses and rubs them, thus fixing the geometry of the spine.

In the lower part of the base 14 of the exemplary rib 12, there is the curvature portion 18, on which the base 14 of the rib 12 is supported on curved arch elements 10 located in the guide grooves 19 of the support parts 13. By being supported on the curved arch elements 10, the base 14 of the rib 12 shapes the bends of the spine and applies forces to the patient back to achieve proper curves. Thanks to the use of the assembly 16 of elastic elements, the back support 15 adjusts to the back by pressing movement of a patient back in engagement therewith, thus achieving a negative image of the back.

Figure 8:
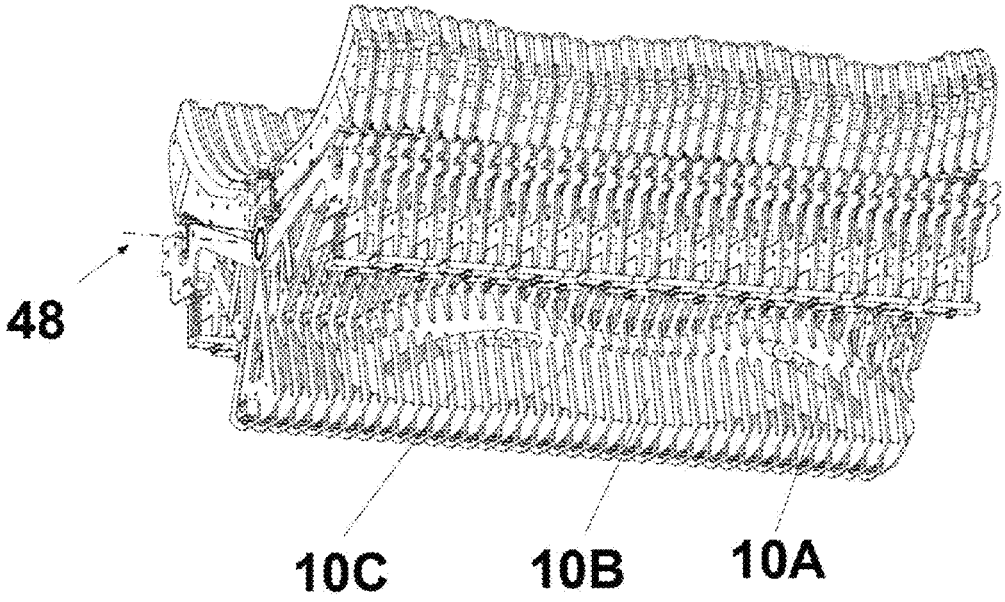
FIG. 8 shows a schematic view of the side of the keyboard with marked curved arch elements A, B and C.
Figure 9:
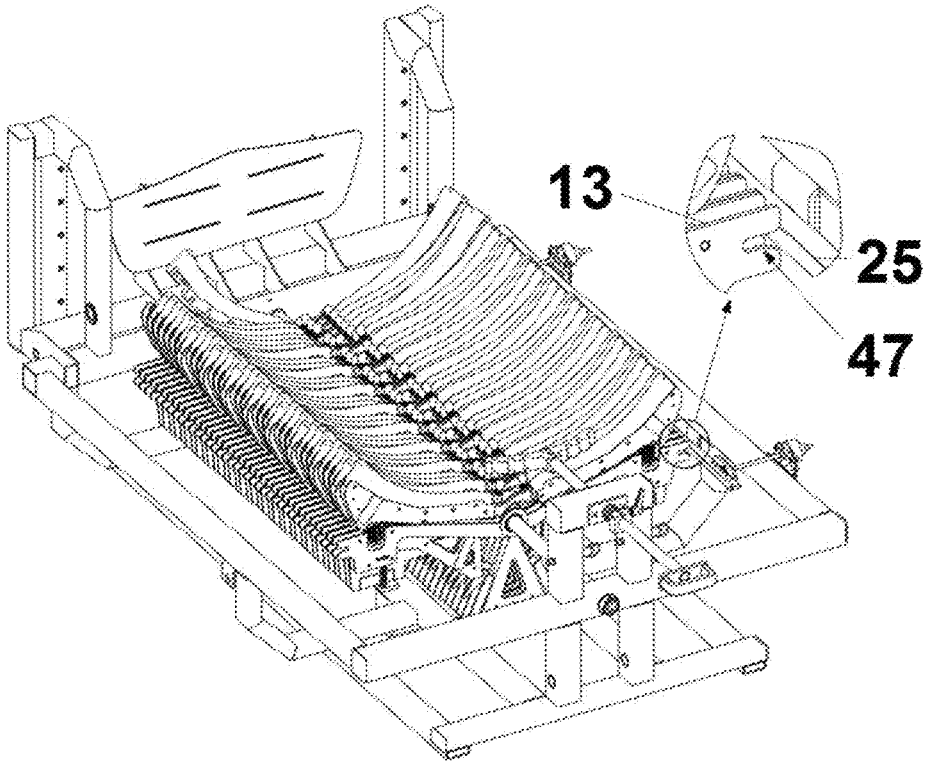
FIG. 9 shows a schematic view of the keyboard with the zeroing mechanism marked.
Figure 10:
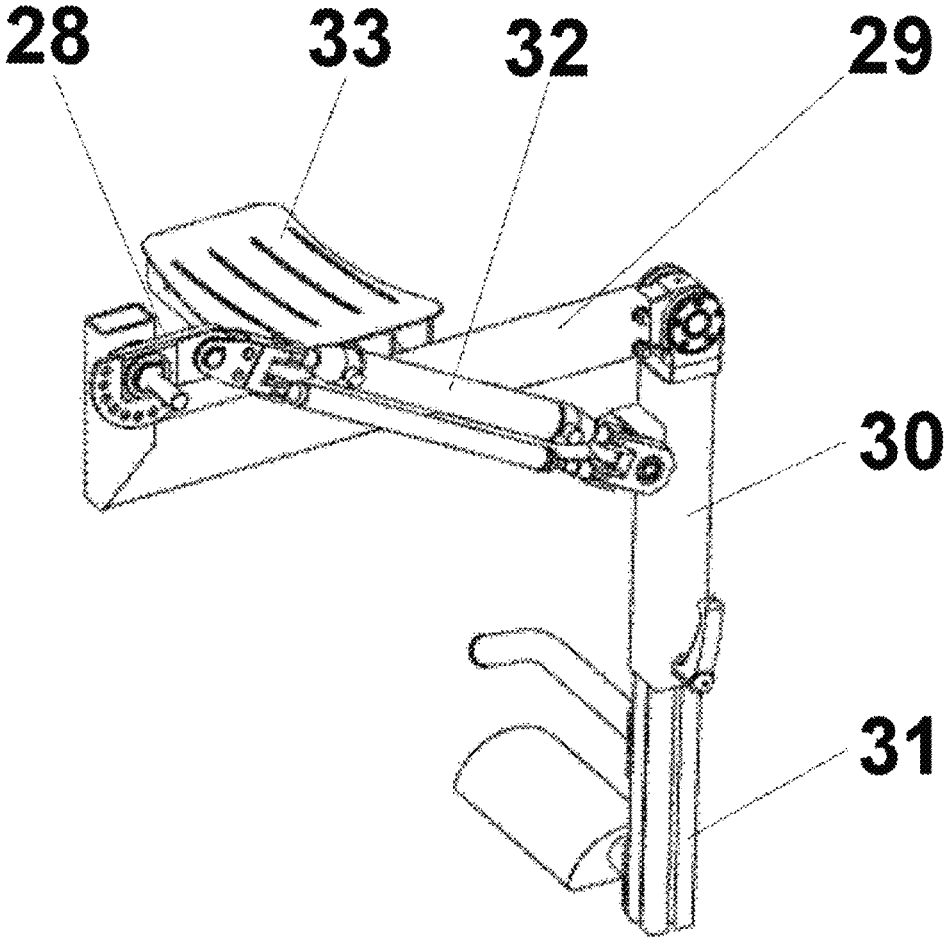
FIG. 10 shows a schematic view of the right resistance mechanism for the patient lower limbs.
Figure 11:
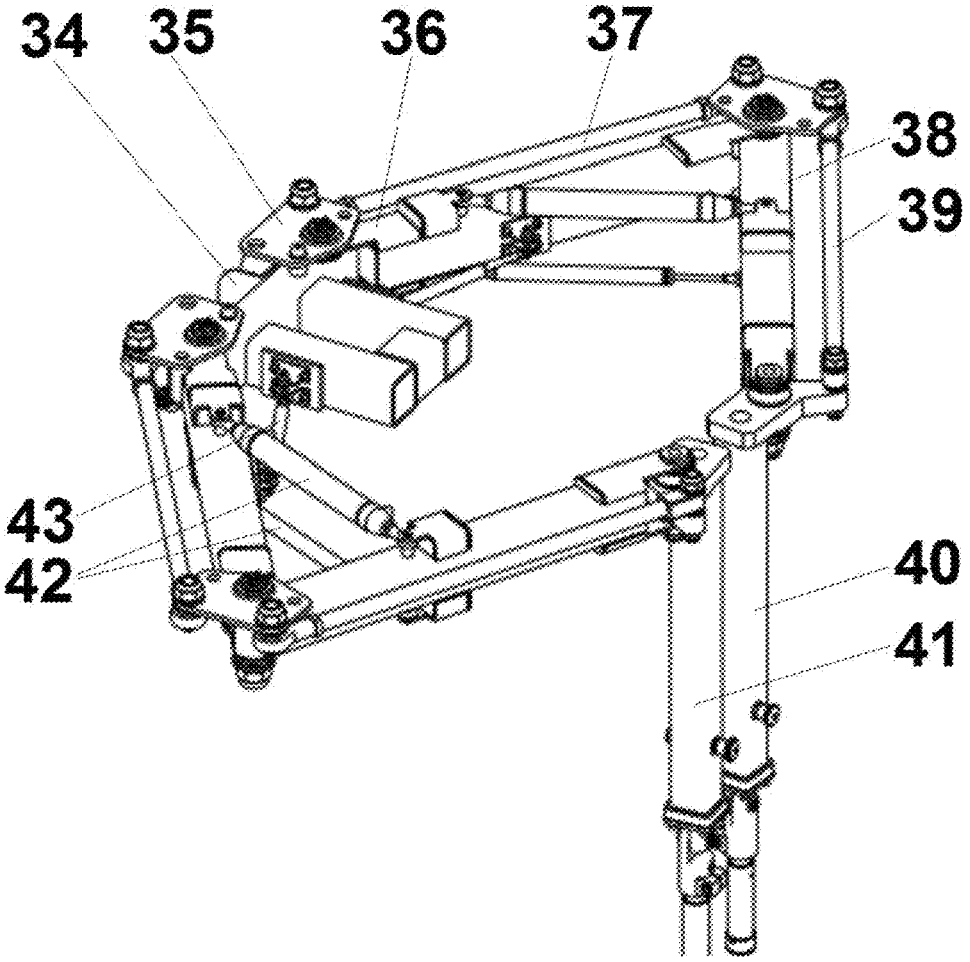
FIG. 11 shows a schematic view of the resistance mechanism for the patient upper limbs.
Figure 12:
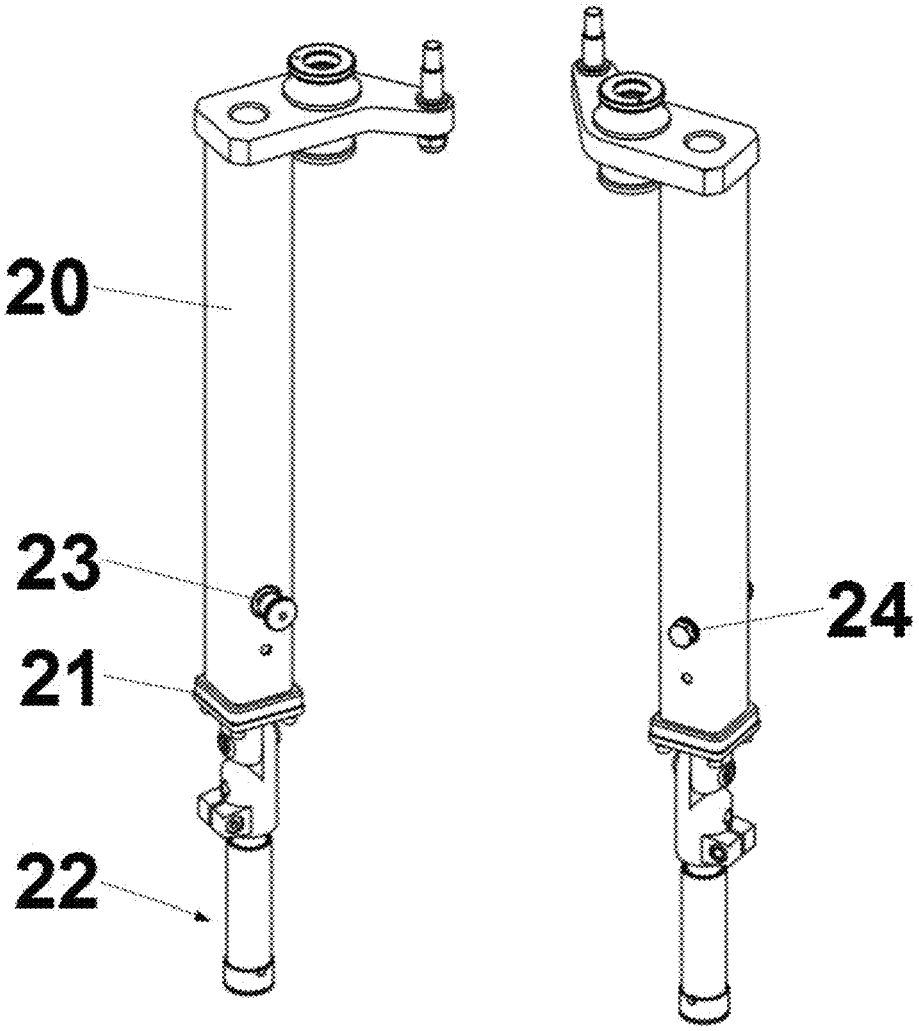
FIG. 12 shows a schematic view of the end assembly of the resistance mechanism for the patient upper limbs.
Figure 13:
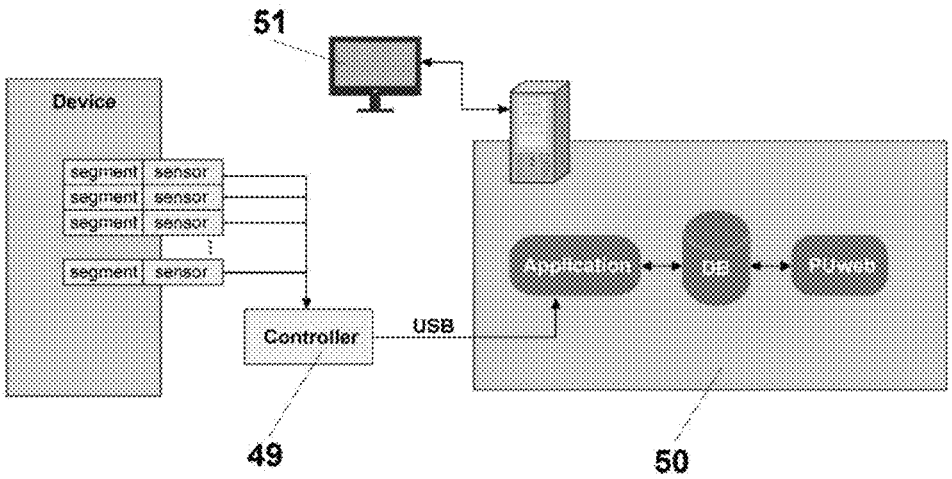
FIG. 13 shows a functional diagram of an exemplary system.

In the exemplary embodiment, there are 6 curved arch elements 10, shown in FIG. 8, which are elements of predefined strictly defined shapes. They are distributed into two sets with three curved arch elements each (10A, 10B and 10C), as shown in FIG. 1*a* and FIG. 8. Each set consists of two smaller curved arch elements 10A and 10C located on the opposite ends of the larger curved arch element 10C. The curved arch elements 10A and 10C are convex on both sides and are used for proper lordotization of the cervical and the lumbar sections of the spine, while the central curved arch element 10B, which is concave on one side, is much longer and ensures correction of the shape of the thoracic kyphosis.

In the example embodiment, the support part 13 on the external ends of the opposite longer arms, has shaped cut-outs 47 in which a zeroing rod 25 may be located. The zeroing mechanism 5 of the keyboard 3 is used for forcing relative movement of successive neighboring segments of the keyboard 3 in order to locate the base of each segment sensor. The zeroing mechanism 5 constitutes the modular part fixed to the mobile frame 2. Zeroing of the keyboard 3 is performed by placing the zeroing rod 25 between the interlocking shaped cut-outs 47 in the support parts 13 of the segments of the keyboard 3. The shaped cut-outs 47 are selected so that in the final phase, they enable permanent blocking of the keyboard 3, and, after the zeroing rod 25 is moved back, the keyboard 3 returns to the zero position thanks to its own elastic elements 44. Due to the large number of segments, at the first stage of zeroing, the zeroing rod 25 is pressed to the segments on one side only. By pressing on the other side, the successive segments of the keyboard 3 are then gradually forced to move.

The exemplary resistance mechanisms 4 and 6 for the upper limbs and the lower limbs are fixed to the mobile frame 2. The resistance mechanisms 4 and 6 are modular structures and are independent of the structure of the mobile frame 2. Consequently, replacement or modification of the resistance mechanisms 4 and 6 does not require changes to the structure of the mobile frame 2.

At the base of the mobile frame 2, there are, symmetrically located, two resistance mechanisms 4 for the lower limbs (RMLL), working with the right and the left lower limb, respectively. The function of the RMLL mechanisms is to provide a load during the performance of patient exercises in the horizontal position of the mobile frame 2. Each resistance mechanism 4 for the lower limbs comprises the thigh frame 29, connected through a kinematic couple of the 5th class, to a shin frame 30 ended with a stirrup. The stirrup consists of a foot support 31, a proper support and a foot lock. The shin frame 30 constitutes a guide for the foot support 31, forming with it a progressive couple. The example shin frame 30 has a device to selectively lock the position of the foot support 31, in the form of a compression lever.

In another embodiment, in the structure of the stirrup or, more exactly, in the structure of the proper support, a force measurement sensor mechanism is located.

The exemplary thigh frame 29 with the shin frame 30 additionally provides connection to the resistance assembly 32, which is spread between the fixed lock 28 and the shin frame 30. The exemplary resistance assembly 32 comprises active resistance elements and passive resistance elements. An active resistance element includes a gas spring, which ensures the initial resistance force and brings the mechanism to the starting position during rest. Operation of the active resistance elements ensures that the resistance assembly 32 is brought to the fixed position, where the thigh frame 29 and the shin frame 30 are in constant orientation in relation to the lock 28. A passive resistance element includes a hydraulic choke of regulated choking action, which is used for adjusting the resistance force in the pushing direction.

The exemplary lock 28 is used for controlling the initial configuration of resistance of the patient lower limbs. A change in the orientation of the lock 28 in relation to the mobile frame 2 results in a change in the initial, forced position of the lower limbs, from the sitting position to the curled-up position.

On the inner side of the exemplary thigh frame 29, the profiled support 33 is located. The purpose of both thigh frames 29, the left one and the right one, is to approximately replicate the movement of the patient's thighs, thus constituting additional support for them in the rest position by using the profiled foot supports 31.

The exemplary two upper limb resistance mechanisms 6 (ULRM), installed symmetrically in the upper part of the mobile frame 2, are intended to provide a load on the upper limbs during the performance of exercises in the horizontal position. The shared part of both resistance mechanisms 6 is the mounting base 34, which is a welded structure with assembly elements, connected through a kinematic couple to an arm 36. In the example embodiment, the kinematic couple is a rotating couple of the 5th class, namely a rotating articulated joint with a single degree of freedom. The arm 36 is further connected, through the kinematic couple of the 5th class, to the forearm 38 ending, respectively, at the left and right end assembly 40 and 41. The exemplary arm 36 and the forearm 38 are welded structures consisting of steel profiles and assembly elements. The distance between the left kinematic couple, which connects the arm 36 to the forearm 38, and the right kinematic couple, in the folded position, is equal to 1,220 mm, and in the furthest open position—to 1,630 mm.

The exemplary arm 36 and the forearm 38 are connected to a main resistance assembly 42, which comprises elastic elements. The main resistance assembly 42 ensures regulated resistance force acting against the upper limbs during the performance of exercise. The elastic elements that are used are active resistance elements and passive resistance elements. An active resistance element includes a pulling gas spring, which ensures the initial resistance force and brings the mechanism to the starting position. The passive resistance elements are used to adjust the resistance force in the pushing direction; an example of which is a hydraulic choke with selective regulation of appropriate choking.

Additionally, in the exemplary arrangement the arm 36 is connected to the mounting base 34 with the auxiliary resistance assembly 43 in the form of a pushing gas spring. The auxiliary resistance assembly 43 ensures return of the mechanism to the initial configuration, i.e. the position with the arms open, and secures the limb mechanism against a free, uncontrolled drop of the mobile frame 2 to the horizontal position.

The arm 36 and the forearm 38 in the example arrangement are surrounded on the outside by the parallelogram mechanism, i.e. a connection between the articulated joint node 35 to the spreader of the arm 37 and the spreader of the forearm 39. The two symmetrical parallelogram mechanisms ensure constant orientation of the ends 40 and 41 together with the handle 22 in relation to the mounting base 34.

The exemplary assemblies of the ends 40 and 41 are welded structures, which constitute the framework for the adjustable handle 22. The distance between the left end assembly 40 and the right end assembly 41 in the folded position in the example arrangement is equal to 300 mm, and in the most opened position—720 mm.

The handle 22 is adjusted by releasing the positioning pin, i.e. the position lock 23. Protection against dropping and constant orientation of the handle 22 in relation to the end 20 is provided by the blocking pin, i.e. the drop lock 24. The handle 22 is fixed to the welded end 20 through the handle mount 21, which enables adjustment of its height. The handle 22 has an additional articulated joint, which enables setting its orientation in relation to the end 20.

Another example embodiment of the device for spine correction is a wheelchair with adjustable back support and a lying rest position, for ill persons and for mobile observation of ill persons by medical staff. On a typical framework of a wheelchair, a torso support is fixed, which, on the bottom, has curved arch elements 10, and the entire framework is covered with soft padding. The supports of the legs may include fixed chair mechanisms that push the lower limbs to the fully straightened position, so that, together with the segments of the keyboard 3 and the seat, they form a couch.

Another example embodiment of the device for spine correction may be a part of an airplane seat for space crafts, constituting an integrated unit for physical exercises in closed kinematic arches, for example in conditions of no gravity.

In exemplary embodiments, in the case of most structures, namely the welded frames, the load-bearing structures of the resistance mechanisms 4 and 6, improved-quality S335J0 steel, formerly designated as 18GA, is used. In the structure of the example bumpers, rubber is used, and plastics are used in the liners. Small elements of the structure and elements of the segments of the keyboard 3 are made from duraluminium, designated as EN-AW 6060, formerly designated as PA 38. The material used for pins, pads, spacer elements and load-bearing structures of the example resistance mechanisms 4 and 6 is 4H13 stainless steel. In order to avoid excessive friction, thus avoiding generation of unpleasant sounds by the elements that move in relation to each other, PTFE foil is applied.

In an exemplary first phase of rehabilitation, the device for spine correction analyzes the position assumed by the person while sitting—this is a negative reproduction of the spine and the surface of the person's back on the tangential arched segments of the device for spine correction. In an exemplary next phase, automatic reproduction, i.e. assumption and rendering of the shape of the back and the spine, is performed. The back of the patient who undergoes the procedure constitutes a model of the shape that is implemented by the device for spine correction. The basic movement of the exemplary device for spine correction is rotation of the spine along the long axis. In the exemplary therapy, direct and indirect action is effected on the intervertebral joints, i.e. the so-called movement parts, the intervertebral disks and the intervertebral joints and the stabilizing system, i.e. the ligaments and the muscles, which are stretched. Both these systems constitute a functional entity and interact with the neighboring functional entities of the spine, providing in each segment support for the entire body. As a result, all the mechanical functions of the movement segment are strictly related with the posture of the body and enable mobilization of all joints of the spine in a position that relieves the spaces between the joints.

The exemplary rehabilitation starting position for the movement of the device for spine correction is the position of the spine described as neutral, i.e. intermediate position between a bent position and a straight position. In this position, the joint surfaces are under the lowest load in the so-called movement part, and the stabilising system, namely the muscles, the ligaments and the joint capsule, are under the least tension. This is useful for exemplary embodiments, because previously known devices have not secured so perfectly the position evenly along the entire spine, while correcting it so thoroughly.

A measurement system, according to an example arrangement, comprises a controller 49 operatively connected to a set of sensors 26 of segments A, B and C of the device for spine correction, and operatively connected to the server 50, which is connected to a display screen 51.

Figure 7:
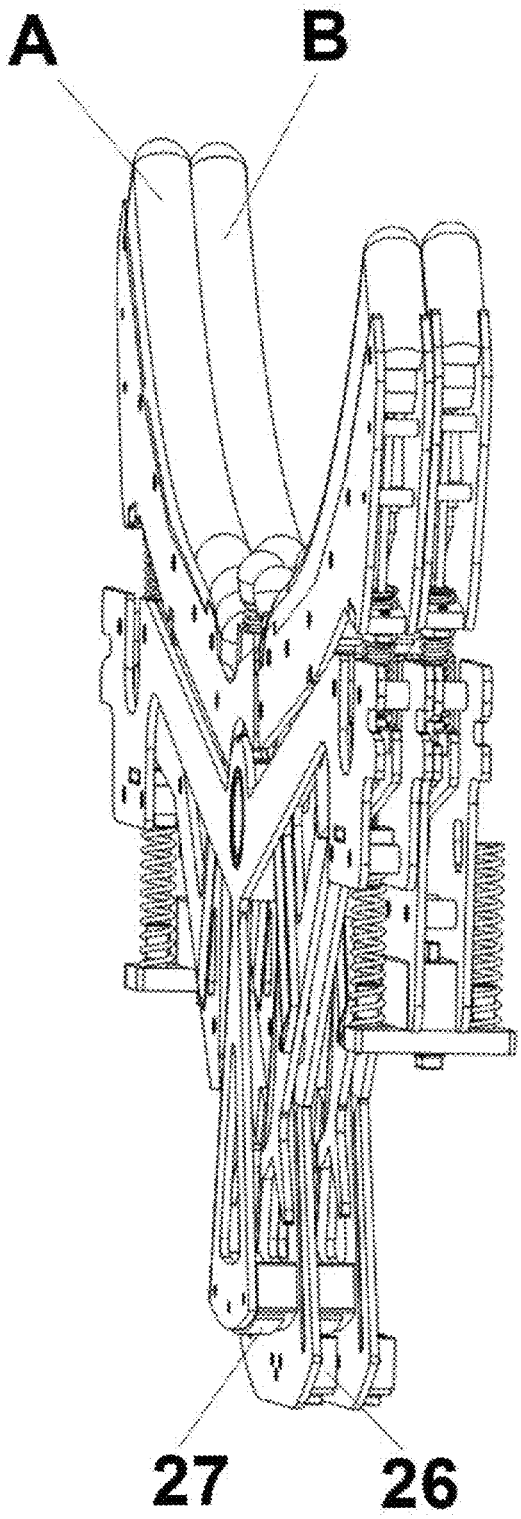
FIG. 7 shows a schematic view of a side of a part of the keyboard of the example device for spine correction.

The exemplary sensors 26 and a magnetic tape 28 are included in the exemplary measurement system. The sensors and tape are located in the lower section of the support part 13 as represented in FIG. 7. During the operation of the device, the sensor 26, located on one segment, reads its position and, consequently, reads the position of the segment to which it is fixed providing at least one signal corresponding thereto. The information on the segment rotational position is taken from the magnetic tape 27 located on the neighboring segment. Thus, the degree of torsion of segments of keyboard 3, and indirectly of the spine of the patient lying on the keyboard, is measured. This enables physiotherapeutic monitoring of the safe performance of the procedure. Changes in the differences in mobility in time are recorded and analyzed by an analyzing program that operates in the server, the controller or other computer device.

As has been mentioned, the exemplary measurements of segment positions are read by sensors 26, based on the position of the sensors relative to the respective magnetic tapes 27 located on each of the segments of the keyboard 3. The measurement assembly signals obtained based on the sensors are sent by the controller 49 to the local server 50. The exemplary sensors 26 are electronic elements in which Hall Effect magnetic sensors are used, which ensure sensing of the relative displacement of the sensors 26 in relation to the magnetic tape 27 located at a distance that is not greater than 1 mm from the sensor.

In one example embodiment, in the system, the server 50 together with the screen 51 include a monoblock PC that is connected to the controller 49, which enables collecting the measurement signals from the sensors of the device and transmitting them to the local server 50. The example controller 49, using an application, records the measurements in the database, at a given time, i.e. at a time the physical therapist presses an examination start button. In another example embodiment, a start/stop button on the device or other input device is pressed.

The example controller 49 is an electronic device that includes circuits that enable collecting and transforming the signals from the sensors 26 and transmitting them via a USB connection to the local server 50, where an application comprised of processor or other circuit executable instructions visualizes the signals on the screen 51 and/or saves them in a database, in the form of relative readouts.

The example local application and database server 50 is used for recording of the measurements performed by the device in the rehabilitation, for recording patient data and their handling within the scope of the services provided that are connected to the device for spine correction and other data that is necessary for the functioning of the device for spine correction.

In the example embodiment, the screen 51 includes a touch screen connected to the local server 50 and is used for presentation and to receive user inputs corresponding to approval of patient data, as well as for presentation of instruction materials.

In the example embodiment, the system uses an application, which is software in the form of a desktop application working on the local server 50; the application enables work with the administrative functionalities of the device for spine correction, as well as recording and viewing the measurement results and the patients' data. The application is suitable for use with a touch screen 51.

Also, in an example embodiment, the system uses the Web PU application, i.e. software in the form of a web application, working on the local server 50, which enables managing patient data and entering it into the measurement system.

In an example embodiment, the system comprises sensors installed on the device for spine correction, which enable measuring the relative position of the segments of the keyboard 3 and measuring the movement activity of the individual parts of the spine, as well as a sensor of the horizontal position of the keyboard 3, which indicates the proper start and end of the rehabilitation procedure. In an example arrangement each rehabilitation procedure is recorded with reference to the data of the specific patient, the date and the time, as well as the data pertaining to the patient's condition. In some example arrangements the basic minimum data concerning condition includes the patient's weight, pressure and heart rate before and after the rehabilitation procedure performed on the device for spine correction using the measurement system.

In an example embodiment, in the measurement system, the process of measurement and recording of change in the position of segments of the keyboard 3 starts when the physiotherapist pushes the examination start button in the application or the start/stop button in connection with a device executing the device for spine correction. A sitting patient, with his or her back positioned along the keyboard 3, together with the mechanism of the keyboard 3, is moved into the horizontal position. When the keyboard 3 reaches the horizontal position, the horizontal position sensor for the mobile frame sends a signal to the application and indicates the time of commencement of recording of the proper part of the rehabilitation procedure. Recording of the measurements ends when the physiotherapist presses the examination end button in connection with the device executing the application or the start/stop button on the device for spine correction; after that, the keyboard 3 in supporting connection the patient back returns to the vertical position.

Another example embodiment of the device for spine correction with a measurement system is an anti-pressure-sore hospital bed for exercises and upright standing. The assembly of the mobile frame 2 with the upright standing drive, i.e. the drive assembly 7, to which a foot rest, similar to that used in airplane seats, is fitted, is fixed to the typical structure of a hospital bed. The control mechanism is programmed so that the bed's movements are controlled by voice commands from the patient or the medical staff. The device for spine correction enables performance of any number of rotational and upright standing movements without involving unnecessary human assistance in the process, which also reduces the workload of the medical staff. In special cases, the patient is fixed with typical stabilization belts.

Advantages of the example embodiments of the device for spine correction and the measurement system is its action as a device that automatically adjusts the size of the supports to the size of the patient. During the rehabilitation—procedure, dynamic muscular training takes place, as well as directed, specifically predefined movement for simultaneous unblocking of blocked mobility in the joints of the spine. Additionally, these actions are controlled, measurable and repeatable until the intended effect, performed directly by the patient and under the control of the physical therapist and the measurement system, which records the entire session of physiotherapeutic action on the patient. Automatically, through operation of the software that is specially designed for this purpose, the patient's parameters are read and recorded, including those that define the changes in the range of the angular movement of the rotating segments, as well as the force used by the individual limbs, the duration of the procedure and other predefined parameters. The exemplary device for spine correction, together with the measurement system, enables measurement, collection, processing and analysis of data pertaining to the condition of the patient and his or her rehabilitation at a given time.

It should be understood that the arrangements of structures, sensors, mechanisms, circuitry, programs and operations described in connection with the previously described embodiments are exemplary and in other embodiments, other approaches and arrangements may be used.

Thus the exemplary embodiments achieve improved operation, eliminate difficulties encountered in the use of prior devices and systems and attain the useful results described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the inventions are not limited to the specific features shown and described.

It should be understood that features and/or relationships associated with one embodiment can be combined with features and/or relationships from another embodiment. That is, various features and/or relationships from various embodiments can be combined in further embodiments. The inventive scope of the disclosure is not limited to only the embodiments shown or described herein.

Having described the features, discoveries and principles of the exemplary embodiments, the manner in which they are constructed and operated, and the advantages and useful results attained, the new and useful structures, devices, elements, arrangements, parts, combinations, systems, operations, equipment, methods, processes and relationships are set forth in the appended claims.

| List of Designators | |
|---|---|
| 1 | Fixed frame |
| 2 | Mobile frame |
| 3 | Keyboard |
| 4 | Resistance mechanism for the lower limbs |
| 5 | Keyboard zeroing mechanism |
| 6 | Resistance mechanism for the upper limbs |
| 7 | Drive assembly |

-continued

| List of Designators | |
|---|---|
| 8 | Glisson's loop |
| 9 | Side belt lock |
| 10 | Curved arch elements |
| 11 | Torsional axis drive |
| 12 | Rib |
| 13 | Support part |
| 14 | Rib base |
| 15 | Back support |
| 16 | Spring assembly |
| 17 | Pushing device |
| 18 | Curvature |
| 19 | Guide groove |
| 20 | Welded end |
| 21 | Handle mount |
| 22 | Handle |
| 23 | Position lock |
| 24 | Drop lock |
| 25 | Zeroing rod |
| 26 | Sensor |
| 27 | Magnetic tape |
| 28 | Lock |
| 29 | Thigh frame |
| 30 | Shin frame |
| 31 | Foot support |
| 32 | Resistance assembly |
| 33 | Profiled support |
| 34 | Mounting base |
| 35 | Articulated joint node |
| 36 | Arm |
| 37 | Arm spreader |
| 38 | Forearm |
| 39 | Forearm spreader |
| 40 | Left end |
| 41 | Right end |
| 42 | Main resistance assembly |
| 43 | Auxiliary resistance assembly |
| 44 | Elastic elements (springs) |
| 45 | Upper flexible element bracket |
| 46A | Lower flexible element bracket |
| 46B | Lower flexible element bracket |
| 47 | Shape cuts |
| 48 | Patient rolling axis |
| 49 | Controller |
| 50 | Server |
| 51 | Screen |
| 10A | Curved arch surface A |
| 10B | Curved arch surface B |
| 10C | Curved arch surface C |
| 13A | Support part of segment A |
| 13B | Support part of segment B |
| A | Segment A |
| B | Segment B |
| C | Segment C |

We claim:

1. A device usable in connection with human spine correction activity, comprising:

a support frame, a mobile frame, wherein the mobile frame is movably mounted in operatively supported connection with the support frame, wherein the mobile frame is configured to have a selectively changeable vertical orientation relative to the support frame, a keyboard, wherein the keyboard is in operatively supported connection with the mobile frame, wherein the keyboard is configured for operative engagement with human backs, wherein the keyboard includes a plurality of relatively movable adjacent segments, wherein the keyboard includes at least one set of three cooperating segments, at least one curved arch element, wherein at least one surface of the at least one curved arch element corresponds to a desired back configuration, wherein the three cooperating segments in at least one set are positioned through operatively supported connection with the at least one curved arch element.

2. The device according to claim 1 wherein each segment of each set includes a support part, wherein the support part includes a pair of opposed arms, and two relatively movable ribs, wherein each rib is movable independently of the other rib in operatively supported connection with a respective arm.

3. The device according to claim 2 wherein each set includes three cooperating segments A, B and C, wherein the opposed arms associated with segment A are narrower in a direction transverse to a direction of movement of the segments than the arms associated with segments B and C, and further including a plurality of elastic elements and brackets, wherein the elastic elements are operatively connected to respective segments B and C through the brackets, and wherein first brackets connected to segment C are positioned 180° relative to brackets connected to segment B.

4. The device according to claim 2 wherein the ribs are rotationally movable about a common axis, wherein the axis corresponds to a patient rolling axis, wherein each rib includes a rib base, wherein the rib base is in rotatable connection with the rib through a swivel connection, wherein the swivel connection is disposed away from the axis on a first side thereof, a plurality of curved back supports, wherein each curved back support is in operatively supported connection with a respective rib, a plurality of springs, wherein at least one spring operates to movably bias each respective rib and back support in a location disposed further away from the axis on the first side than the respective swivel connection.

5. The device according to claim 2 wherein each set includes three cooperating segments, wherein the segments of the set cooperate with each other through flexible elastic elements.

6. The device according to claim 4 wherein each support part further includes a pair of symmetrical guide grooves, wherein each rib base includes a curvature portion, wherein the curvature portion is disposed from the axis, wherein at least one curved arch element extends in one of the pair of guide grooves in a plurality of support parts, wherein each curvature portion is in operatively supporting engagement with the surface of a curved arch element.

7. The device according to claim 6 wherein one of a pair of symmetric curved arch elements extend in each respective guide groove of each respective support part.

8. The device according to claim 7 wherein the at least one curved arch element surface has a predetermined shape that corresponds to a desirable back shape.

9. The device according to claim 8 wherein the guide slots and curved arch elements are configured such that the curved arch elements extend in a pair of planes and each of such planes extend through the axis.

10. The device according to claim 7 and further comprising a plurality of sensors, wherein the each sensor is configured to measure a rotational position of a respective segment.

11. The device according to claim 10 and further including a controller and a server, and a display screen in operative connection with the server, wherein the plurality of sensors is in operative connection with the server through the controller, wherein the server is operative to cause the screen to output visual information responsive at least in part to the angular positions sensed through the plurality of sensors.

12. The device according to claim 7 wherein at least one of the pair of arms of each support part includes a shaped cutout, wherein the shaped cutout is configured to accept a zeroing rod, whereby the zeroing rod enables alignment of the support parts.

13. The device according to claim 7 wherein the mobile frame has in operatively supported connection therewith, two symmetrically positioned resistance mechanisms for patient lower limbs, each including a thigh frame connected through a kinetic couple to a shin frame and ending in a stirrup, wherein the thigh frame is operatively connected to the shin frame through a resistance assembly that includes elastic elements that include a pulling gas spring and a hydraulic choke, and wherein a profiled support is located on an inner side of the thigh frame.

14. The device according to claim 13 wherein the mobile frame ends at a top portion, wherein positioned adjacent the top portion are two symmetrical resistant mechanisms for patient upper limbs, wherein the symmetrical resistant mechanisms include a shared mounting base connected through a kinetic couple to at least one arm, wherein the at least one arm is connected through a kinetic couple to a forearm ending with an end assembly, and wherein the arm and the forearm are connected to a main resistance assembly which includes elastic elements including a pulling gas spring and a hydraulic choke.

15. The device according to claim 14 wherein each segment is in operative connection with a sensor, wherein the sensor is operative to sense at least one rotational position of the segment, and further including at least one server in operative connection with each of the plurality of sensors, wherein the at least one server is in operative connection with a screen, and wherein the at least one server is operative to cause the screen to provide at least one output responsive at least in part to readings by the plurality of sensors.

16. The device usable in connection with human spine correction activity, comprising:

a keyboard including a plurality of movable arcuate segments, wherein the movable arcuate segments are each configured to be engageable with a human back, wherein the movable arcuate segments are each movably supported in operative connection with a frame, wherein the movable arcuate segments each include a pair of back supports, wherein the back supports of a respective movable arcuate segment extend on opposed sides of an axis, wherein the axis corresponds to a patient rotating axis of a patient back in contact with the keyboard, a plurality of elastic biasing elements, wherein the elastic biasing elements are operative to bias each back support of each pair in opposed rotational directions and toward a patient back in engagement with the back support, at least one curved arch element, wherein the at least one curved arch element corresponds to a desired back configuration, wherein the elastic biasing elements are in operative supported connection with the at least one curved arch element, whereby the back supports are configured to provide biased engagement with a patient back that corresponds to the desired back configuration.

17. The device according to claim 16 wherein each segment includes an associated rib and support part, wherein the support part includes at least one guide slot, wherein at least one curved arch element extends transversely in the guide slot.

18. The device according to claim 16 wherein the plurality of segments include at least one set of segments, wherein each set includes three segments, wherein each of the three segments in the set interact with other segments of the set through flexible elastic elements.

19. The device according to claim 17 wherein each rib operatively supports a respective back support, and further including a rib bracket, wherein the rib bracket is in operatively rotatable connection with each rib, wherein each rib bracket includes a curvature portion that operatively engages a curved arch element, wherein each rib bracket is in operative connection with a respective back support through at least one elastic element, wherein each support part comprises two opposed arms, wherein each arm generally underlies a respective back support, wherein each support part is rotatable about a support extending along the axis, wherein each respective rib bracket is operatively engaged to a respective arm of a support part through at least one elastic element, a plurality of sensors, wherein each sensor is configured to sense a rotational position of a respective support part and provide signals corresponding thereto, a server in operative connection with a screen, wherein the plurality of sensors is in operative connection with the server, wherein the server is operative to provide outputs through the screen responsive at least in part to sensor signals from the plurality of sensors.

20. A device usable in connection with human spine correction activity, comprising:

a keyboard, wherein the keyboard includes a plurality of pairs of opposed, longitudinally adjacent back supports, wherein the back supports are configured to engage human backs, wherein the back supports of each pair are configured to be rotatably movable relative to a longitudinal axis, wherein the axis corresponds to an axis of patient rotation of backs in connection with the keyboard, a plurality of elastic elements, wherein the plurality of elastic elements are in operative connection with respective back supports, wherein each of the plurality elastic elements are in operative connection with at least one curved arch element, wherein the at least one curved arch element corresponds to a desired back contour, wherein the back supports are operative to bias patient backs in engagement therewith, to assume the desired back configuration, at least one limb movable arm, wherein the at least one limb movable arm is configured to be movable against the resistance force by at least one limb of a patient whose back is in engagement with the keyboard, a plurality of sensors, wherein the plurality of sensors is operative to sense rational positions of respective pairs of back supports, at least one server in operative connection with the plurality of sensors, wherein the at least one server is operative to provide at least one output responsive to signals received from the plurality of sensors.

21. A device usable in connection with human spine correction activity, comprising:

a plurality of pairs of opposed longitudinal adjacent back supports, wherein the back supports are configured to engage human backs, wherein the back supports of each pair are configured to be rotatably movable relative to a longitudinal axis, wherein the longitudinal axis corresponds to a patient rotating axis of a patient back in contact with the plurality of pairs of back supports, a plurality of elastic biasing elements, wherein the elastic biasing elements are operative to bias the back supports of each pair in opposed rotational directions and toward a patient back in engagement with the respective back support, at least one curved arch element, wherein the at least one curved arch element corresponds to a desired back configuration, wherein the elastic biasing elements are in operative supported connection with the at least one curved arch element, whereby the back supports are configured to provide biased engagement with a patient back that corresponds to the desired back configuration.

* * * * *